US006996928B1

(12) United States Patent
Lux et al.

(10) Patent No.: US 6,996,928 B1
(45) Date of Patent: Feb. 14, 2006

(54) DISPLAY SYSTEM FOR CHAIN LINK FENCE

(76) Inventors: Edward Lux, 1312 S. Lyman Ave., Glendora, CA (US) 91740; Debbie Lux, 1312 S. Lyman Ave., Glendora, CA (US) 91740

( * ) Notice: Subject to any disclaimer, the term of this patent is extended or adjusted under 35 U.S.C. 154(b) by 0 days.

(21) Appl. No.: 10/424,380

(22) Filed: Apr. 28, 2003

Related U.S. Application Data

(60) Provisional application No. 60/376,861, filed on May 1, 2002.

(51) Int. Cl.
*E04H 17/00* (2006.01)

(52) U.S. Cl. ..... 40/611.11; 40/611.01; 256/1

(58) Field of Classification Search ..... 40/611.01, 40/611.02, 611.06, 611.08, 611.11, 622, 618; 256/1, 32
See application file for complete search history.

(56) References Cited

U.S. PATENT DOCUMENTS

| | | | | | |
|---|---|---|---|---|---|
| 507,952 | A | * | 10/1893 | White | 40/583 |
| 991,041 | A | * | 5/1911 | Toennes | 405/20 |
| 1,064,897 | A | * | 6/1913 | Gabet | 40/583 |
| 3,774,884 | A | * | 11/1973 | Singer | 256/32 |
| 3,964,197 | A | * | 6/1976 | Tucker et al. | 40/584 |
| 5,177,890 | A | * | 1/1993 | Hisatomi et al. | 40/447 |
| 5,441,239 | A | * | 8/1995 | Watson | 256/1 |
| D465,291 | S | * | 11/2002 | Marshall | D25/119 |
| 6,669,175 | B1 | * | 12/2003 | Snow et al. | 256/32 |

* cited by examiner

*Primary Examiner*—Mark T. Le

(57) ABSTRACT

A display system for a chain link fence that includes a number of plastic inserts adapted to be secured within the fence link openings of a section of chain link fencing.

1 Claim, 2 Drawing Sheets

DISPLAY SYSTEM FOR CHAIN LINK FENCE

This application claims the benefit of provisional application No. 60/376,861, filed May 1, 2002.

TECHNICAL FIELD

The present invention relates to decorative systems and more particularly to a display system for a chain link fence that includes a number of plastic inserts each having a presentation side of one of a number of different colors and a number of side edges provided with grooves therein for receiving a number of sections of wire forming a fence link in a section of chain link fencing; the user inserting plastic inserts into the openings of user selected fence links with the presentation side of the plastic insert directed in the desired direction in order to create a user created display.

BACKGROUND ART

Many individuals have chain link fences that they would like to decorate but do not feel comfortable using plastic cups, plastic strips, ribbons, etc. to create a decorative display. It would be desirable, therefore, to have a chain link fence display creating system that included a number of plastic inserts having a presentation side of a desired color and that included side edges provided with grooves for specifically receiving the wire forming the links of the chain link fence in a manner to snugly hold the plastic insert even under windy and rainy conditions.

GENERAL SUMMARY DISCUSSION OF INVENTION

It is thus an object of the invention to provide a display system for a chain link fence that includes a number of plastic inserts each having a presentation side of one of a number of different colors and a number of side edges provided with grooves therein for receiving a number of sections of wire forming a fence link in a section of chain link fencing; the user inserting plastic inserts into the openings of user selected fence links with the presentation side of the plastic insert directed in the desired direction in order to create a user created display.

Accordingly, a display system for a chain link fence is provided. The display system for a chain link fence includes a number of plastic inserts each having a presentation side of a particular color and a number of side edges provided with grooves therein for receiving a number of sections of the wire that forms the fence links in a section of chain link fencing. The plastic inserts are sized such that the user may snugly and securely insert plastic inserts into the openings of user selected fence links with the presentation side of the plastic insert directed in the desired direction in order to create a user created display.

In preferred embodiments, the plastic insert may be hollow and provided with an illumination source to make it glow; provided with a handle on a back side opposite the presentation side to ease installation and removal of the plastic inserts; or constructed of pliable plastic and including a v-shaped indentation that extends back from the presentation side to form a handle as well as to provide a spring effect that allows the user to pinch the handle during insertion and removal but which expands when the user releases the handles to securely position the grooves of the side edges over sections of fence wire forming the fence link.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
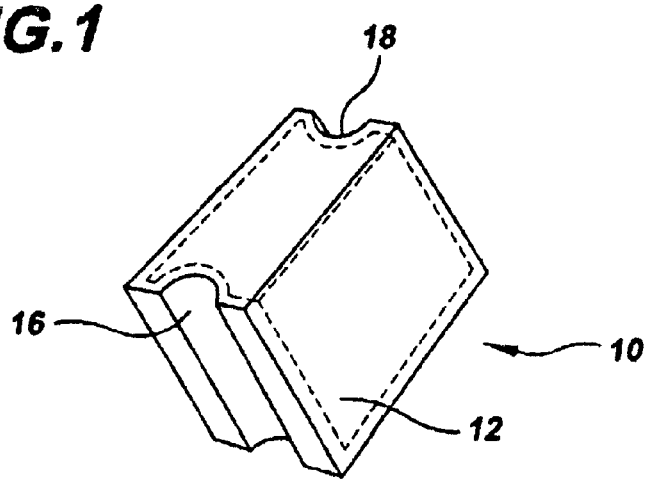
FIG. 1 is a perspective view of an exemplary embodiment of a plastic insert of the display system for chain link fence of the present invention showing the presentation side and the two grooved side edges.
Figure 2:
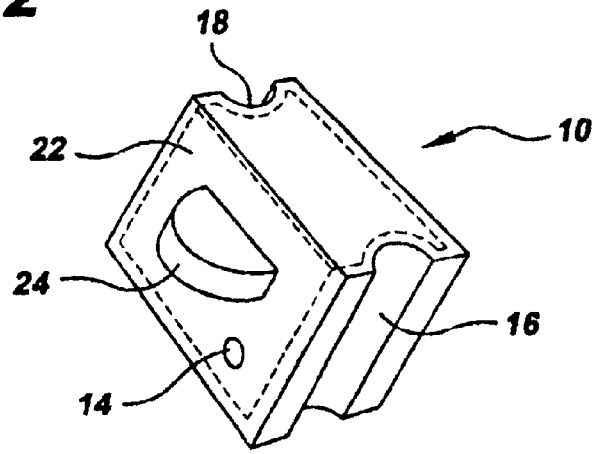
FIG. 2 is a perspective view of the plastic insert of FIG. 1 showing a handle provided on the back side and a bulb opening for allowing a user to insert a bulb into the hollow interior of the insert.
Figure 3:
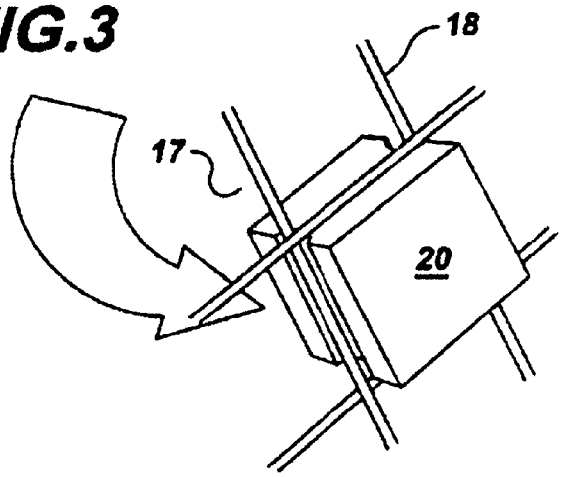
FIG. 3 is a perspective view of the plastic inset of FIG. 1 installed into the link opening of a representative chain link fence section.

FIGS. 1–3 show various aspects of an exemplary embodiment of a plastic insert, generally designated 10, of the display system for a chain link fence of the present invention. Plastic insert 10 is formed of molded plastic and has a hollow interior 12 that is accessible through a bulb opening 14; two grooved side edges 16,18 for receiving sections of fence wire 17,18 therein during installation; a presentation side 20 that is smooth; and a back side 22 having a handle 24 extending outwardly therefrom.

Figure 6:
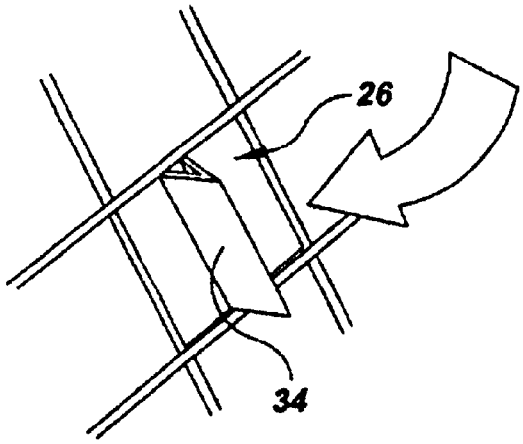
FIG. 6 is a perspective view of the plastic inset of FIG. 4 installed into the link opening of a representative chain link fence section.
Figure 5:
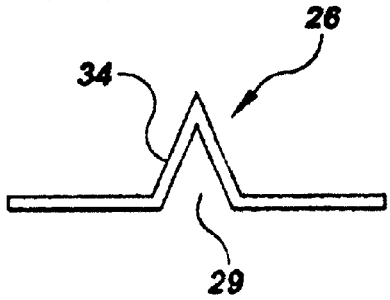
FIG. 5 is a to plan view of the plastic insert of FIG. 4.
Figure 4:
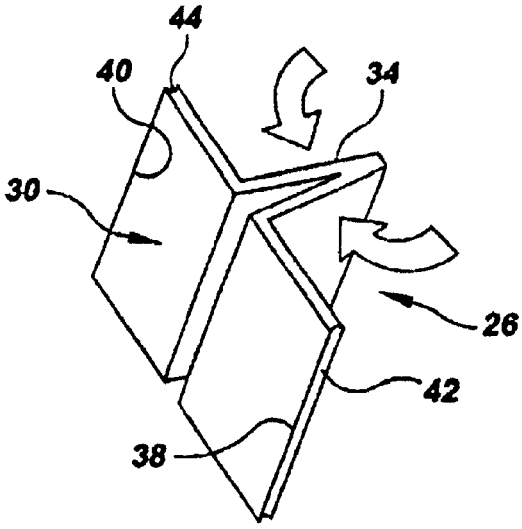
FIG. 4 is a perspective view of a second exemplary embodiment of the plastic insert of the display system for a chain link fence of the present invention.

FIGS. 4–6 show a second exemplary plastic insert, generally designated 26, that is formed of pliable plastic. Plastic insert 26 has a central biasing groove 29 formed through the center of the presentation face 30 that extends back to form a compressible handle structure 34. The side edges 38,40 of presentation face 30 each have a fence wire groove 42,44, respectively.

It can be seen from the preceding description that a display system for a chain link fence has been provided.

It is noted that the embodiment of the display system for chain link fence described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A display system for a chain link fence comprising:

a number of plastic inserts each having a presentation side of one of a number of different colors and a number of side edges provided with grooves therein for receiving a number of sections of wire forming a fence link in a section of chain link fencing;

each of the number of plastic inserts having the grooves positioned such that each of the number of plastic inserts is insertable into a fence opening formed by the sections of wire forming a particular fence link in a manner such that the plastic insert is retained in the fence opening by the positioning of the sections of wire;

the presentation side of the plastic insert is directed in the desired direction and a number of the plastic inserts are each inserted into a particular fence opening in a manner to create a user created display;

each of the number of plastic inserts being constructed of pliable plastic and including a v-shaped indentation that extends back from the presentation side to form a handle;

the v-shaped indentation also providing a spring effect that biases the plastic insert into an expanded configuration;

the v-shaped indentation being squeezable to decrease the size of the plastic insert and increase the ease of installation.

* * * * *